US007191554B2

(12) United States Patent
Almanzar et al.

(10) Patent No.: US 7,191,554 B2
(45) Date of Patent: Mar. 20, 2007

(54) STEAM IRON

(75) Inventors: Sergio A. Almanzar, Miramar, FL (US); Maria C. Duque, Miami, FL (US); Michael R. Fretwell, Weston, FL (US)

(73) Assignee: Applica Consumer Products, Inc., Miramar, FL (US)

( * ) Notice: Subject to any disclaimer, the term of this patent is extended or adjusted under 35 U.S.C. 154(b) by 78 days.

(21) Appl. No.: 11/126,858

(22) Filed: May 10, 2005

(65) Prior Publication Data

US 2005/0278986 A1 Dec. 22, 2005

Related U.S. Application Data

(60) Provisional application No. 60/580,409, filed on Jun. 17, 2004.

(51) Int. Cl.
*D06F 75/22* (2006.01)
*D06F 75/06* (2006.01)

(52) U.S. Cl. ..... 38/77.5

(58) Field of Classification Search ..... 38/77.1, 38/77.3, 77.5, 77.6, 77.8, 77.83, 88, 77, 77.82; 219/245

See application file for complete search history.

(56) References Cited

U.S. PATENT DOCUMENTS

| | | | | | |
|---|---|---|---|---|---|
| 2,817,169 | A | * | 12/1957 | Schott | 38/77.1 |
| 2,832,160 | A | * | 4/1958 | Beach | 38/77.82 |
| 2,883,778 | A | * | 4/1959 | Kistner | 38/77.6 |
| 3,300,884 | A | | 1/1967 | Giarraffa et al. | 38/78 |
| 3,534,488 | A | | 10/1970 | Hardwick et al. | 38/77.3 |
| 3,670,433 | A | | 6/1972 | Hardwick et al. | 38/77.3 |
| 4,688,340 | A | * | 8/1987 | Ostrelich | 38/90 |
| 5,398,434 | A | | 3/1995 | Biancalani | 38/77.3 |
| 5,444,216 | A | * | 8/1995 | Bouleau et al. | 219/245 |
| 5,507,108 | A | | 4/1996 | Bruggink et al. | 38/77.8 |
| 5,526,595 | A | | 6/1996 | Daulasim et al. | 38/77.8 |
| 5,638,622 | A | * | 6/1997 | Hohn | 38/77.5 |
| 6,128,839 | A | * | 10/2000 | Debourg et al. | 38/77.8 |
| 6,163,990 | A | | 12/2000 | Urata et al. | 38/77.8 |
| 6,314,668 | B1 | | 11/2001 | Daulasim et al. | 38/77.8 |
| 6,351,901 | B1 | | 3/2002 | Amsel | 38/77.8 |
| 6,425,197 | B2 | | 7/2002 | Ching et al. | 38/77.3 |
| 6,427,366 | B2 | | 8/2002 | Horn et al. | 38/77.83 |
| D470,288 | S | | 2/2003 | Bas | D32/71 |
| 6,625,910 | B2 | | 9/2003 | Ching et al. | 38/77.3 |
| 6,631,572 | B1 | * | 10/2003 | Garcia | 38/77.1 |
| 6,671,985 | B2 | | 1/2004 | Bouleau | 38/77.3 |
| 6,681,506 | B2 | | 1/2004 | Altmann et al. | 38/77.8 |
| 2001/0042326 | A1 | | 11/2001 | Ching et al. | 38/77.3 |

* cited by examiner

*Primary Examiner*—Ismael Izaguirre
(74) *Attorney, Agent, or Firm*—Baker Botts L.L.P.

(57) ABSTRACT

An electric iron including a housing; a soleplate connected to the housing; a heater for heating the soleplate; a fluid holding system connected to the housing, the fluid holding system including a first fluid reservoir; and a second water only reservoir connected to the soleplate; and a fluid dispensing system for dispensing fluid from the first reservoir and for dispensing water from the second reservoir. The fluid dispensing system includes a spray nozzle connected to the housing and a pump connecting the first reservoir to the spray nozzle. The fluid dispensing system is adapted to dispense fluid from the first reservoir only through the spray nozzle and only without addition of water from the second reservoir.

18 Claims, 6 Drawing Sheets

STEAM IRON

CROSS REFERENCE TO RELATED APPLICATION

This application claims priority under 35 U.S.C. §119(e) from U.S. Provisional Patent Application No. 60/580,409 filed Jun. 17, 2004 which is hereby incorporated by reference in its entirety.

BACKGROUND OF THE INVENTION

1. Field of the Invention

The invention relates to an iron and, more particularly, to a steam iron with multiple fluid reservoirs.

2. Brief Description of Prior Developments

U.S. Pat. No. 6,425,197 discloses an electric iron with a main reservoir for water and an exchangeable reservoir. Fluid from the exchangeable reservoir can be mixed with water from the main reservoir and pumped by a pump out a spray nozzle. Water from the main reservoir can also be delivered to a steam chamber in the soleplate.

U.S. Pat. No. 6,625,910 discloses an electric iron with an exchangeable reservoir. The iron has an electric pump for pumping fluid from the exchangeable reservoir out of a nozzle. A second embodiment has a water reservoir for delivering water to a steam chamber of the soleplate, and for mixing the water with the fluid from the exchangeable reservoir to be pumped out of the nozzle.

There is a desire to provide an electric iron which has two reservoirs wherein liquids in the two reservoirs are kept separate from each other in the iron. There is a desire to provide a steam iron which has the capability of dispensing a fluid having a precise concentration and without being diluted with water from a second main water reservoir of the iron.

SUMMARY OF THE INVENTION

In accordance with one aspect of the invention, an electric iron is provided comprising a housing; a soleplate connected to the housing; a heater for heating the soleplate; a fluid holding system connected to the housing; and a fluid dispensing system for dispensing fluid. The fluid holding system comprises a first fluid reservoir and a second water only reservoir connected to the soleplate. The fluid dispensing system comprises a spray nozzle connected to the housing and a pump connecting the first reservoir to the spray nozzle. The fluid dispensing system is adapted to dispense fluid from the first reservoir only through the spray nozzle and only without addition of water from the second reservoir.

In accordance with another aspect of the invention, an electric iron is provided comprising a housing; a soleplate connected to the housing; a heater for heating the soleplate; and a fluid holding system connected to the housing. The fluid holding system comprises a single multi-reservoir liquid holding tank comprising a first fluid reservoir; and an adjacent second fluid reservoir separated from the first fluid reservoir by a common wall. The iron further comprises a fluid dispensing system for dispensing fluid from the first reservoir and for dispensing water from the second reservoir. The fluid dispensing system comprises a spray nozzle connected to the housing and a pump connecting the first reservoir to the spray nozzle. The fluid dispensing system is adapted to dispense fluid from the first reservoir through the spray nozzle and without addition of water from the second reservoir.

In accordance with one method of the present invention, a method of manufacturing an electric iron is provided comprising providing a multi-reservoir tank having a first reservoir for holding a first liquid and a second reservoir for holding a second liquid, wherein the first and second reservoirs share a common wall; connecting the first reservoir to a spray nozzle by a first conduiting system; and connecting the second reservoir to the soleplate by a second conduiting system. The first and second liquids are maintained separate from each other by the first and second reservoirs and the first and second conduiting systems.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
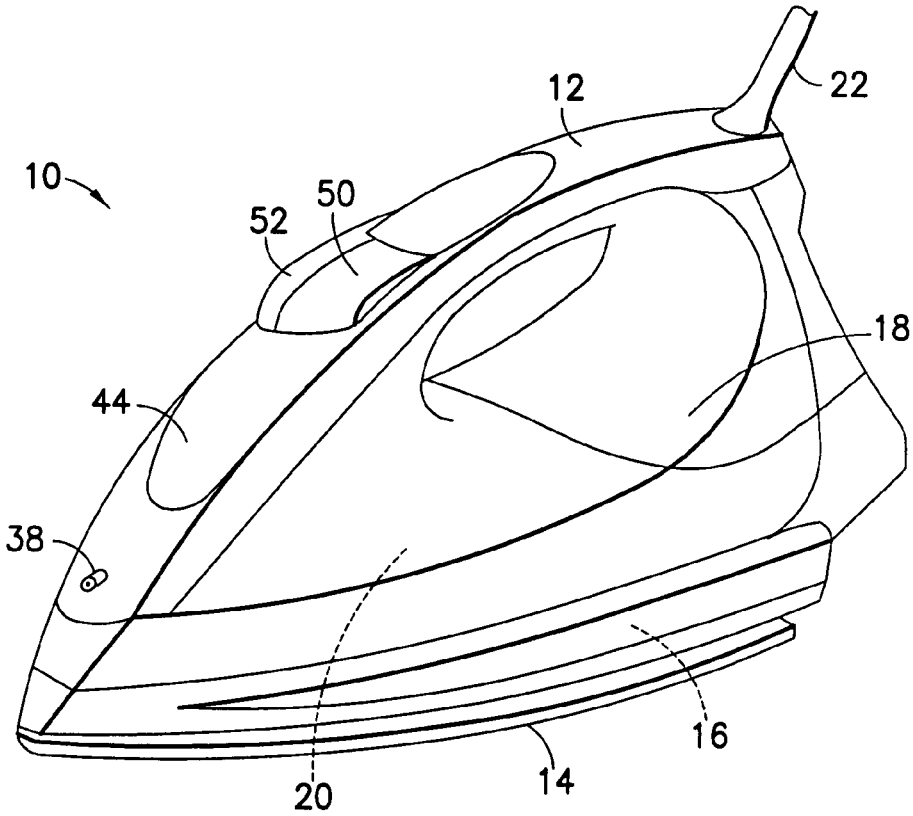
FIG. 1 is a perspective view of an electric steam iron incorporating features of the invention.

Referring to FIG. 1, there is shown a perspective view of an electric steam iron 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The iron 10 generally comprises a housing 12, a soleplate 14, a heater 16 in the soleplate, a fluid holding system 18, and a fluid dispensing system 20. The heater 16 preferably comprises a Calrod in the soleplate, but any suitable type of heater could be provided. An electric cord 22 is connected to the heater 16, such as through a thermostatic control (not shown). The thermostatic control can be adjusted by the user to select a temperature of the soleplate 16. The soleplate 14 comprises a steam chamber and holes through the bottom of the soleplate to dispense steam generated in the steam chamber out of the bottom of the soleplate 14.

Figure 2:
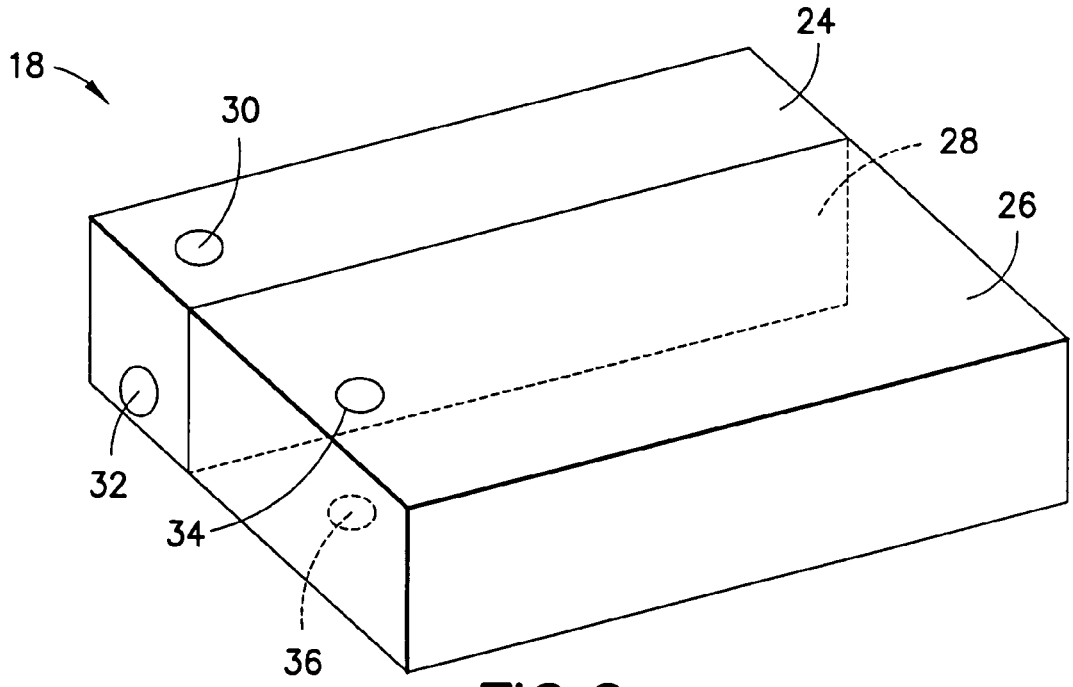
FIG. 2 is a perspective view of the fluid reservoirs used in the iron shown in FIG. 1.

Water to generate the steam is supplied by the fluid holding system 18 and the fluid dispensing system 20. Referring also to FIG. 2, in the embodiment shown, the fluid holding system 18 comprises a first fluid reservoir 24 and a second fluid reservoir 26. In a preferred embodiment, the second fluid reservoir 26 is a water only reservoir intended to hold only water. In an alternate embodiment, the fluid holding system 18 could comprise more than two reservoirs. The two reservoirs 24, 26 are provided as a unitary dual tank container having a single wall 28 separating the two holding chambers of the first and second reservoirs from each other. In an alternate embodiment, the two reservoirs 24, 26 could be separate members. FIG. 2 shows the two reservoirs as being rectangular, however, any suitable shape(s) could be provided. The first reservoir 24 has an inlet 30 and an outlet 32. The second reservoir 26 has an inlet 34 and an outlet 36. The two inlets 30, 34 are connected by conduits to inlet apertures located under a moveable lid 44 at the front of the housing. However, any suitable inlet aperture locations or configurations could be provided.

Figure 3:
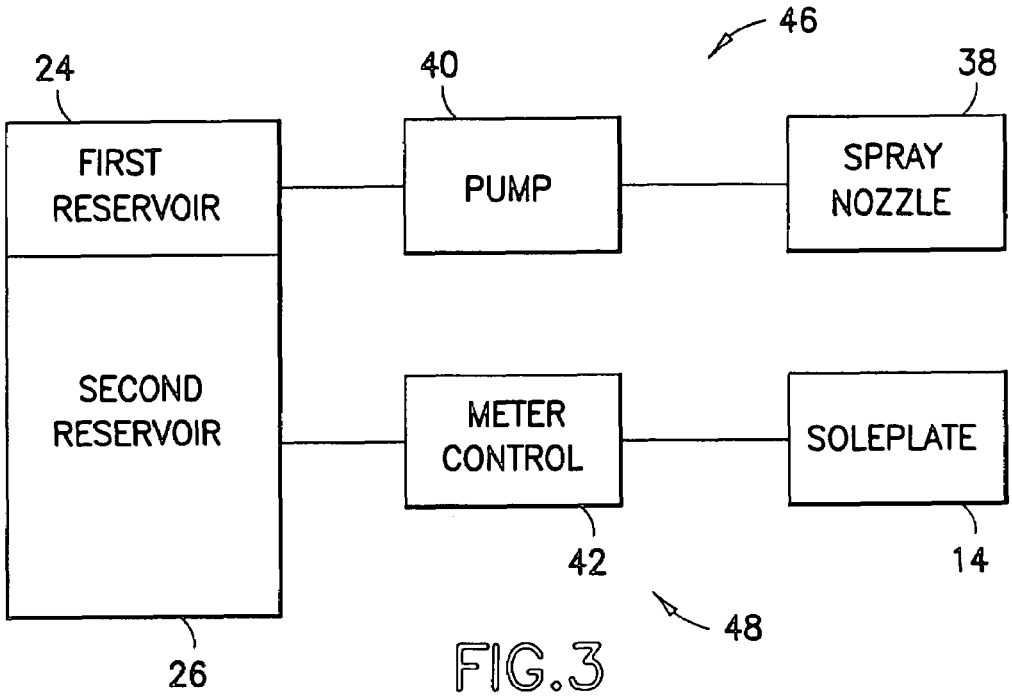
FIG. 3 is a schematic diagram of the two fluid paths provided from the reservoirs shown in FIG. 2.

Referring also to FIG. 3, the first reservoir 24 is connected to a spray nozzle 38 by a pump 40. This forms part of the fluid dispensing system 20. The spray nozzle 38 is located at the front of the housing 12 as seen in FIG. 1. The pump 40 could be a manually actuatable pump or an electric pump. When the pump 40 is actuated, the iron 10 sprays fluid from the first reservoir 24 out of the spray nozzle in front of the iron. The second reservoir 26 is connected to the steam chamber of the soleplate 14 by a meter control 42. This also forms part of the fluid dispensing system. The meter control is adapted to meter the rate of water flow from the second reservoir to the soleplate 14. The meter control 42 could be connected to the thermostatic control to turn the meter control OFF at lower temperatures (and thereby prevent water from entering the steam chamber at lower temperatures.)

Figure 4:
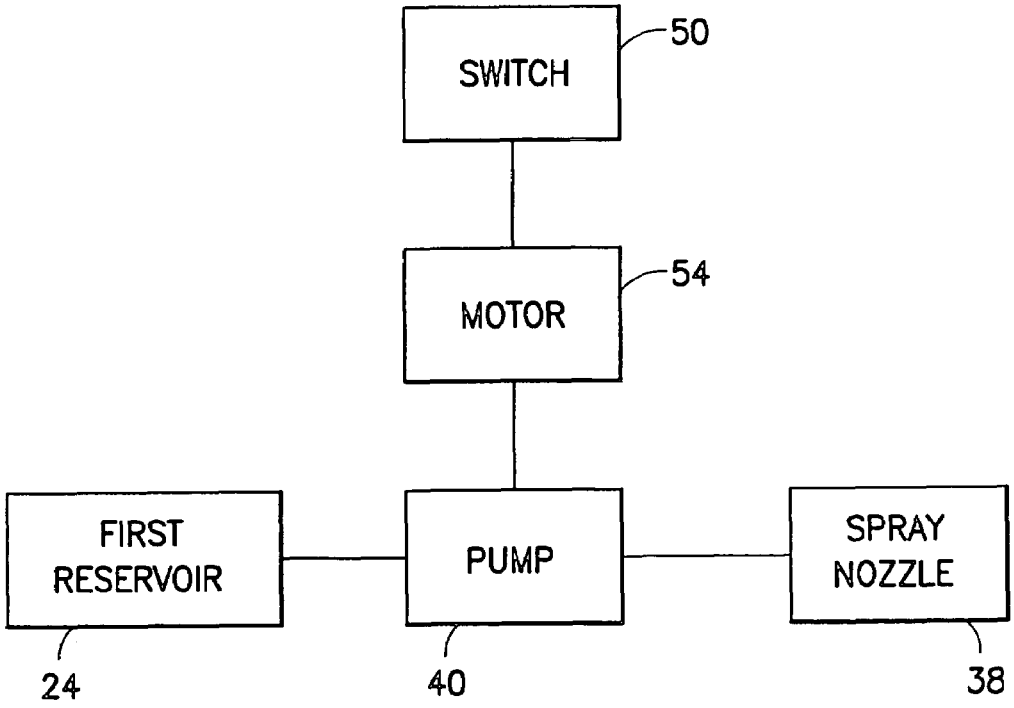
FIG. 4 is a schematic diagram showing one type of embodiment for controlling movement of fluid through the first path shown in FIG. 3.

The pump 40 could comprise a manually actuated pump. As seen in FIG. 1, the iron 10 preferably comprises a spray button 50 and a steam surge button 52. For a mechanically actuated pump, the spray button 50 is mechanically connected to the pump 40. When the button 50 is depressed, the pump 40 is actuated to spray fluid from the first reservoir 24 out of the spray nozzle 38. Referring also to FIG. 4, the pump 40 could comprise an electric pump. In this embodiment the spray button 50 comprises an electrical switch. The switch 50 is connected to a motor 54 which, in turn, is connected to the pump 40. When a user actuates the switch 50, the motor 54 drives the pump 40 to supply fluid from the first reservoir 24 to the spray nozzle 38. In this embodiment, the pump 40 continuously operates until the user releases the switch 50. In an alternate embodiment, the switch 50 and motor 54 could be connected to a controller (not shown) which could be actuated to control the duration of the pumping action by the pump 40 for a predetermined period of time. This predetermined period of time could be based upon one or more factors, such as the temperature of the soleplate 14.

The fluid dispensing system forms two separate paths for dispensing two fluids; the fluid in the first reservoir and the fluid (water) in the second reservoir. The spray nozzle 38 is not connected to the water only second reservoir. One of the features of the invention is the ability to keep the fluid in the first reservoir separate from the water in the second reservoir, and providing two (or perhaps more) paths for dispensing the fluid and water without mixing them together. In a preferred embodiment, the fluid in the first reservoir can comprise a solution or fabric liquid such as a starch, a wrinkle relaxer, a stain guard or scented water. However, any suitable solution or pre-formulated ironing liquid could be provided including plain water if a special feature other than spraying water (such as spraying a solution of starch, or wrinkle relaxer, or stain guard, or scented water) is not desired.

With the invention, because the water from the second reservoir 26 is not mixed with the pre-formulated fluid from the first reservoir 24, the pre-formulated fluid is not diluted and can be applied to the garment being ironed at the fluid's precise manufactured concentration. This allows the fluid to function at its designed concentration without being diluted. This also eliminates the problems associated with precise water/solution metering to produce a desired solution concentration if a condensed or concentrated solution was attempted to be used and mixed with water before being dispensed. In addition, because the fluid dispensing system of the invention provides two separate paths for dispensing two fluids (a first path 46 from the first reservoir 24 and a separate second path 48 from the second reservoir 26), the pre-formulated fluid from the first reservoir will not enter the steam chamber and create deposits which might otherwise result in residual blockages occurring in the steam chamber.

The pre-formulated fluid is dispensed from the first reservoir only through the spray nozzle and only without addition of water from the second reservoir. Water from the second reservoir is dispensed only through the soleplate. However, in an alternate embodiment, water from the second reservoir could be able to be dispensed through the spray nozzle; just separate from dispensing of the fluid from the first reservoir. Both of the reservoirs 24, 26 can be refilled without removing the reservoirs from the housing 12. However, in an alternate embodiment, one or both of the reservoirs could be removable from the housing. In one type of alternate embodiment, the first reservoir 24 could be removable from the housing 12 as a general cartridge, and might not be a refillable cartridge. The invention isolates the water for spray and steam output from the pre-formulated ironing liquid.

Figure 5:
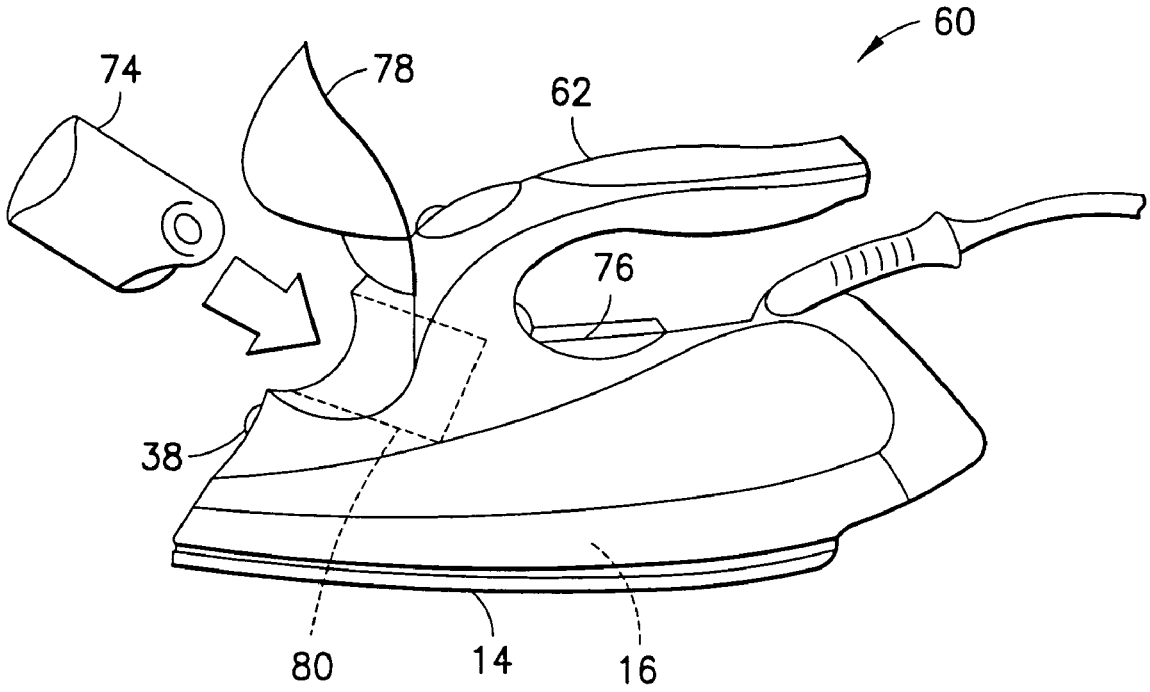
FIG. 5 is a perspective view of an alternate embodiment of an iron incorporating features of the invention.

Referring now to FIG. 5, an alternate embodiment of the invention is shown. In this embodiment the iron 60 generally comprises a housing 62, a soleplate 14, a heater 16 in the soleplate, a fluid holding system, and a fluid dispensing system. The fluid holding system is provided with two reservoirs 74, 76. The two reservoirs 74, 76 are provided as separate members. The first reservoir 74 is preferably provided as a removable cartridge. The second reservoir 76 is non-removably connected to the housing 62. The housing 62 comprises a movable lid 78 and a cartridge receiving area 80 located beneath the movable lid 78.

Figure 6:
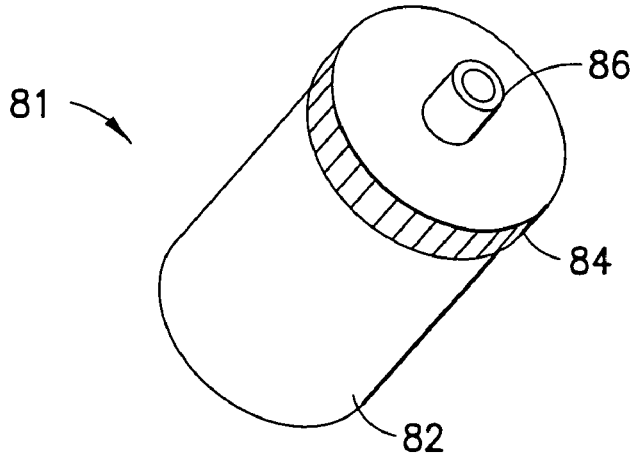
FIG. 6 is a perspective view of an alternate embodiment of a cartridge reservoir for use in the iron shown in FIG. 5.

Water to generate the steam is supplied by the second fluid reservoir 76. In a preferred embodiment, the second fluid reservoir 76 is a water only reservoir intended to hold only water. In an alternate embodiment, the fluid holding system 68 could comprise more than two reservoirs. Spray of liquid from the spray nozzle 38 is provided from the fluid inside the removable cartridge 74. The cartridge 74 could comprise a non-refillable cartridge. Referring also to FIG. 6, the removable cartridge could comprise a cartridge 81 which is adapted to be refilled. In the embodiment shown in FIG. 6, the cartridge 81 comprises a main container 82 and a removable screw-on lid 84. The lid 84 comprises an outlet 86. The outlet 86 preferably comprises a seal which is opened when the cartridge 81 is inserted into the iron. In an alternate embodiment, the main container 82 could comprise the outlet rather than the lid 84.

Similar to the embodiment described above with reference to FIGS. 1–4, liquid is dispensed from the first reservoir 74 only through the spray nozzle 38 and only without addition of water from the second reservoir 76. Water from the second reservoir 76 is dispensed only through the soleplate. However, in an alternate embodiment, water from the second reservoir could be able to be dispensed through the spray nozzle. Only the second reservoir 76 can be refilled without removing the reservoir from the housing 62. The first reservoir 74, on the other hand, would need to be removed from the iron 60 in order to be refilled. The invention isolates the water for spray and steam output from the pre-formulated ironing liquid. Because the water from the second reservoir 76 is not mixed with the fluid from the first reservoir 74, the fluid is not diluted and can be applied to the garment being ironed at its precise manufactured concentration; thereby allowing the fluid to function at its designed concentration without being diluted.

Figure 7:
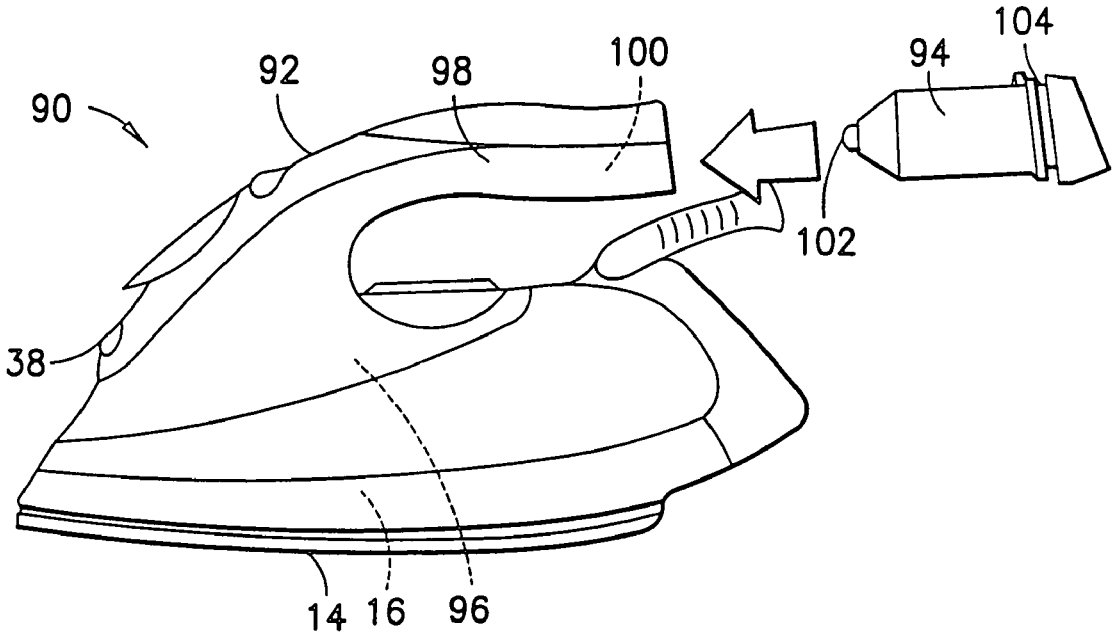
FIG. 7 is a perspective view of another alternate embodiment of an iron incorporating features of the invention.

Referring now to FIG. 7, another alternate embodiment is shown. The iron 90 generally comprises a housing 92, a soleplate 14, a heater 16 in the soleplate, a fluid holding system, and a fluid dispensing system. The fluid holding system is provided with two reservoirs 94, 96. The two reservoirs 94, 96 are provided as separate members. The first reservoir 94 is preferably provided as a removable cartridge. The second reservoir 96 is non-removably connected to the housing 92.

The housing 92 comprises a handle 98 having a cartridge receiving area 100 at an end of the handle. The cartridge 94 is adapted to be plugged into the rear end of the handle 98 into the cartridge receiving area 100. A front end of the cartridge 94 comprises an outlet 102. The rear end of the cartridge 94 comprises a coupling 104, such as a screw thread or friction seal, for stationarily mounting the cartridge 94 to the handle 98. The cartridge 94 is removably connected to the handle 98 and could be refillable or non-refillable. When the cartridge 94 is properly connected to the iron 90, fluid from the cartridge can be supplied to the spray nozzle 38 separate and apart from supply of the water in the second reservoir 96 to the steam chamber inside the soleplate 14. In an alternate embodiment, the removable cartridge could be mounted to any suitable location on the housing of the iron.

In one type of embodiment, an electric pump can be provided for running both spray and steam surge functions of the iron. The iron could be provided with a printed circuit board having an electronic digital control to set and maintain both temperature and steam settings. The iron could be provided with a pressure system to allow surge of steam over a long period of time. The iron could be provided with electronic controls to provide for an anti-drip feature to prevent water from dripping out of the soleplate.

The iron could be provided with a separate steam boiler for low temperature steam. The steam could be generated in a small steam chamber which is not in the soleplate. With the use of a removable cartridge system, interchangeable reservoirs can be provided having different solutions. A user can select one of a number of different cartridges having different fabric treating liquids based upon the need of a particular fabric or the desire of the user. A cartridge system can enhance the ironing experience and ironing outcome performance. The iron could comprise a rapid heat and a rapid cool feature. The iron could also comprise a fabric sensor. An electric spray system and/or an electric steam surge system could be provided for providing consistent performance. A continuous steam burst can be provided using the electronic control to slowly feed water into the steam chamber to allow the iron to create a continuous burst of steam for improved steam performance. The iron could comprise a three-way motion sensitive auto-OFF, such as 10 minutes while upright, 30 seconds while on its side, and 30 seconds while down on the soleplate.

A digital fabric sensing smart steam system could be used to provide the correct temperature and correct amount of steam for a particular cloth type. An electronic spray can be provided to dampen tough wrinkles. The electronic spray can provide a power spray with an even spray that can be used continuously without user fatigue for better ironing results. An electronic surge of steam for a concentrated blast of steam can be provided. The electronic surge of steam can provide a power surge providing the user with an exceptional burst of steam generated by the same electronic pump which is used for a power spray. Continuous surge of steam can be provided to rapidly remove wrinkles. If the iron comprises a separate steam boiler, the iron can be designed to deliver the steam from the steam boiler through the soleplate without passing through the steam chamber of the soleplate replacing the traditional burst of steam function provided by a soleplate. The continuous surge of steam can be designed to go through a concentrated group of the about six to eight holes in the forward center of the iron. A vertical surge of steam can be provided for curtains and hanging garments. Thus, the continuous surge of steam can allow the iron to be used like a hand-held garment steamer. An integrated cartridge system can be provided for providing professional quality results. The iron can be self cleaning to extend the life of the iron. Fabric sensing can be provided to make the whole ironing experience faster with better results. Advantages of a power spray and a burst of steam as described above are a more even, controlled spray, as well as a high burst of steam, at the touch of a button with an electrical switch.

An integrated power spray can be provided which replaces current manual spray pumps. The power spray can be generated with an electronic pumping mechanism. The power spray can provide an even spray over the desired area in an elliptical pattern with a higher quality than current manual pumps. A variable option for spray coverage could be included; ranging from a small area of coverage to a large area of coverage. The power spray can spray evenly out in front of the iron, utilizing an existing orifice, and substantially always in a predictable direction.

The power surge burst of steam can spray evenly out of the soleplate of the iron utilizing the existing openings. The power surge can be generated with an electronic pumping mechanism. The power surge can provide an even surge of steam over the desired area at the same quality or a higher quality than current irons. The continuous surge of steam can provide a burst of steam which will spray easily out of a small concentrated group of holes. The continuous surge can last twice as long as conventional irons, or as long as possible and will be controlled through the electronic surge to meter the water into the steam chamber in order to prevent flooding of the unit, but at the same time providing a continuous surge of steam. The continuous surge can be generated with an electronic pumping mechanism. The power surge can provide an even surge of steam over the desired area at the same quality or higher quality of current irons.

For the continuous burst of steam, an electronic control can be connected to a valve which slowly feeds water into the steam chamber or boiler to allow the electric iron to create a continuous burst of steam. The continuous burst of steam may be stopped when the temperature of the iron's soleplate falls below a predetermined level or after a predetermined time of use. The electric spray can comprise a control which is connected to a motor which operates a pump to spray water or other fluid through the spray nozzle. The spray nozzle comprises a dedicated spray nozzle. In most conventional irons, the spray nozzle is connected to the water reservoir of the iron. With the invention, the spray nozzle can be connected to a separate cartridge rather than the water supply reservoir. The iron's main reservoir could be separated into two compartments; one compartment could utilize the water for conversion to steam and the other compartment could utilize the fluid, such as the odor remover FABREEZE® or a wrinkle releaser liquid, such as DOWNY WRINKLE RELEASER®, to be delivered to the spray nozzle. The iron could also comprise two heaters. The soleplate could have its own heater and the boiler could have its own separate heater. Essentially, one heater would be dedicated for ironing purposes only to heat the soleplate. The other heater would be dedicated to the creation of steam only.

Figure 8:
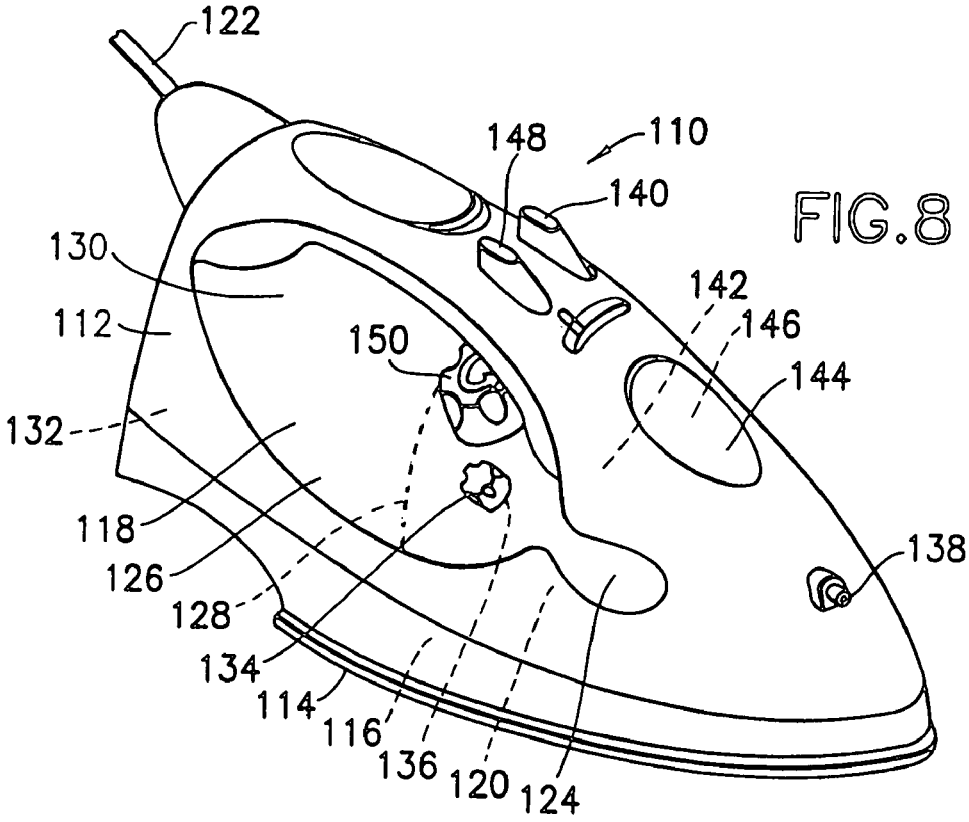
FIG. 8 is a perspective view of an alternate embodiment of the invention.

Referring now to FIG. 8 an alternate embodiment of the present invention is shown. In this embodiment the iron 110 comprises a housing 112, a sole plate 114, a heater 116, a fluid holding system 118, a fluid delivery system 120 and an electric cord 122. The fluid holding system 118 comprises a multi-reservoir tank comprising a first reservoir 124 and a second reservoir 126. The first reservoir 124 is located at least partially in front of the second reservoir 126. Preferably, the first and second reservoirs share a common wall 128 which separates the chambers of the reservoirs from each other. The tank could be a one piece member, but in a preferred embodiment the tank comprises a top member 130 and a bottom member 132 which are attached to each other, such as by ultrasonic welding. In the embodiment shown, the top member 130 is at least partially translucent or transparent such that a user can visually see fluid levels in the reservoirs. The common wall 128 is preferably integrally formed with the two reservoirs.

A cap 134 is screwed onto an entrance 136 into the first reservoir 124. The entrance 136 is located at a middle section of the housing and at a right lateral side of the housing. However, in alternate embodiments, the entrance could be located at any suitable location. The cap is unscrewed to pour fluid into the first reservoir. The fluid delivery system 120 comprises a first conduiting system for conduiting the first fluid from the first reservoir to the spray nozzle 138. The first conduiting system includes a spray button 140 connected to a pump 142.

A movable lid 144 is located at a top of the iron at an entrance 146 to the second fluid reservoir 126. The lid 144 can be pivoted open to pour water into the second reservoir. However, in alternate embodiments, the entrance could be located at any suitable location. The fluid delivery system 120 comprises a second conduiting system for conduiting the second fluid from the second reservoir to the sole plate 114. The second conduiting system includes a water meter connected to a fabric-select dial 150 and a surge-of steam button 148.

Figure 9:
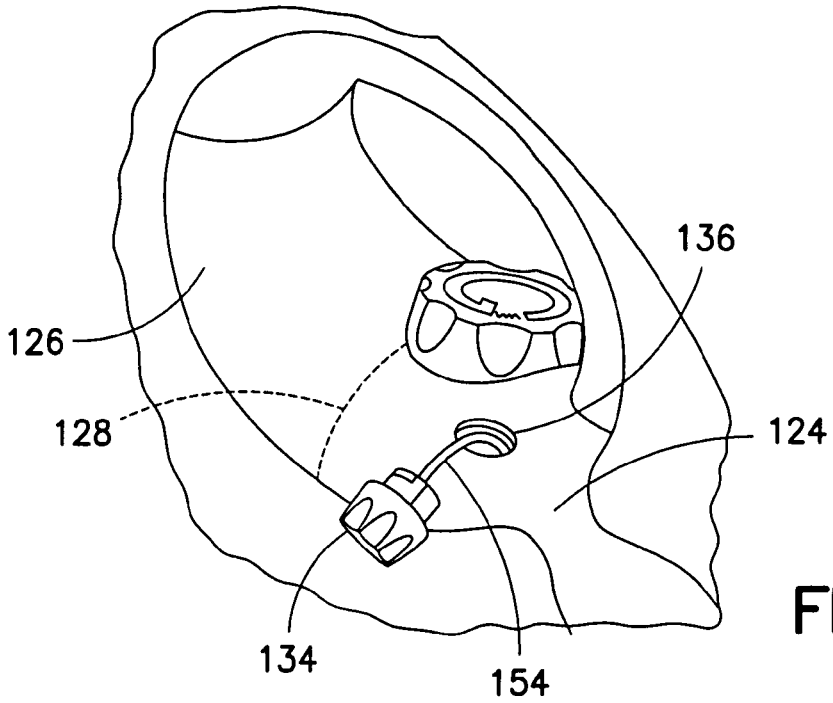
FIG. 9 is a perspective view of a portion of the iron shown in FIG. 8 with the cap unscrewed.
Figure 10:
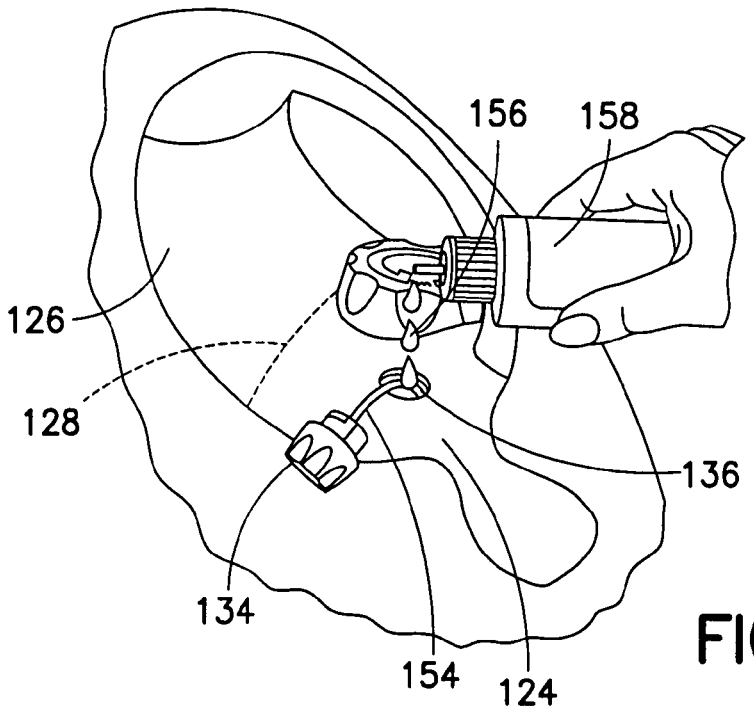
FIG. 10 is a perspective view as in FIG. 9 showing pouring of liquid into the first reservoir.
Figure 11:
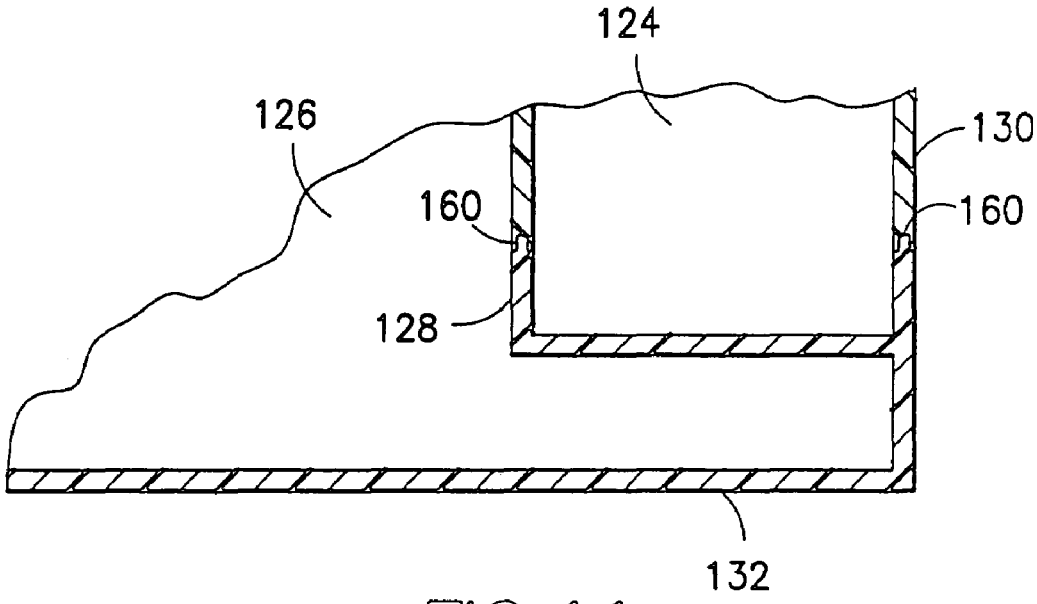
FIG. 11 is a partial cross sectional view of the multi-reservoir tank of the iron shown in FIG. 8.

Referring also to FIGS. 9–10, the cap 134 can be connected to the housing by a tether 154 extending into the entrance 136. Thus, the cap 134 can stay attached to the housing while the first liquid 156 is poured into the entrance 136 from a bottle 158. However, the tether might not be provided. In this embodiment the cap 134 is screwed into the entrance 136. Referring also to FIG. 11, portions of the top and bottom members 130, 132 of the multi-reservoir tank are shown along with the common wall 128. In this embodiment the members 130, 132 can be ultrasonically welded together at the joint 160. However, any suitable connection could be provided. In this embodiment the first reservoir 124 is located at least partially in front of the second reservoir 126, but a portion of the second reservoir extends under the first reservoir. In alternate embodiments, any suitable shape or configuration could be provided.

Figure 12:
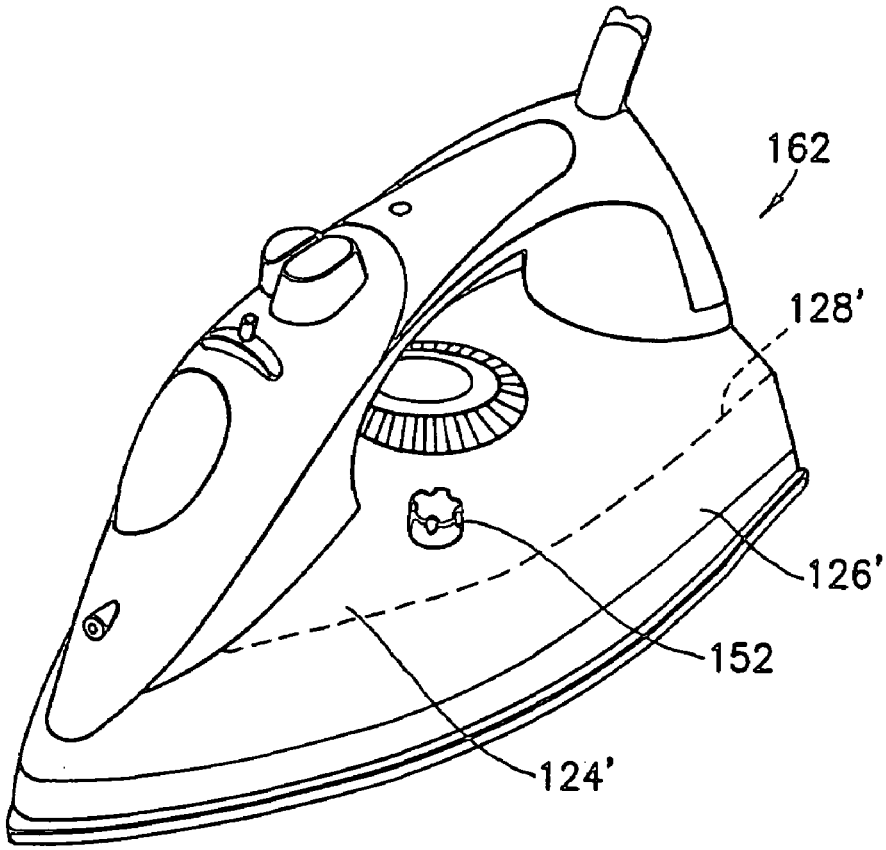
FIG. 12 is a perspective view of another alternate embodiment of the present invention.

Referring also to FIG. 12, another alternate embodiment is shown. In this embodiment the iron 162 has the cap 152 to the entrance to the first reservoir 124' located at the left lateral side of the iron. The multi-reservoir tank has the first reservoir 124' located above the second reservoir 126' along a majority of the length of the iron and sharing a common wall 128'. However, as noted above, any suitable configuration or shapes of the reservoirs with a common wall could be provided.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electric iron comprising:

a housing;

a soleplate connected to the housing;

a heater for heating the soleplate;

a fluid holding system connected to the housing, the fluid holding system comprising a single multi-reservoir liquid holding tank comprising:

a first fluid reservoir; and an adjacent second fluid reservoir separated from the first fluid reservoir by a common wall; and a fluid dispensing system for dispensing fluid from the first reservoir and for dispensing water from the second reservoir, wherein the fluid dispensing system comprises a spray nozzle connected to the housing and a pump connecting the first reservoir to the spray nozzle, wherein the fluid dispensing system is adapted to dispense fluid from the first reservoir through the spray nozzle and without addition of water from the second reservoir;

wherein the fluid dispensing system comprises a first conduiting path from the first reservoir to the spray nozzle and a completely separate second conduiting path from the second reservoir to the soleplate.

2. An electric iron as in claim 1 wherein the first reservoir is located at least partially in front of the second reservoir.

3. An electric iron as in claim 1 wherein the common wall comprises an integral wall which is integrally formed with the first and second reservoirs.

4. An electric iron as in claim 1 wherein the single multi-reservoir liquid holding tank comprises a top member and a bottom member connected to each other to form the reservoirs.

5. An electric iron as in claim 1 wherein the housing comprises a movable lid on a top of the housing covering a water entry into the second reservoir.

6. An electric iron as in claim 5 wherein the housing comprises a movable cap at a middle section of the housing covering a fluid entry into the first reservoir.

7. An electric iron as in claim 6 wherein the cap is screwed onto the housing and is connected by a tether to the housing.

8. An electric iron as in claim 6 wherein the fluid entry into the first reservoir is located at a lateral side of the housing.

9. An electric iron comprising:

a housing;

a soleplate connected to the housing;

a heater for heating the soleplate;

a fluid holding system connected to the housing, the fluid holding system comprising:

a first fluid reservoir; and a second water only reservoir connected to the soleplate; and a fluid dispensing system for dispensing fluid from the first reservoir and for dispensing water from the second reservoir, wherein the fluid dispensing system comprises a spray nozzle connected to the housing and a pump connecting the first reservoir to the spray nozzle, wherein the fluid dispensing system is adapted to dispense fluid from the first reservoir only through the spray nozzle and only without addition of water from the second reservoir;

wherein the first and second reservoirs are housed in a single container having a single integral wall separating holding chambers of the first and second reservoirs from each other.

10. An electric iron as in claim 9 wherein the fluid dispensing system is adapted to dispense water from the second reservoir only through the soleplate.

11. An electric iron as in claim 9 wherein the single container comprises a top member and a bottom member connected to each other to form the reservoirs.

12. An electric iron as in claim 9 wherein the housing comprises a movable lid on a top of the housing covering a water entry into the second reservoir.

13. An electric iron as in claim 12 wherein the housing comprises a movable cap at a middle section of the housing covering a fluid entry into the first reservoir.

14. An electric iron as in claim 13 wherein the cap is screwed onto the housing and is connected by a tether to the housing.

15. An electric iron as in claim 13 wherein the fluid entry into the first reservoir is located at a lateral side of the housing.

16. An electric iron as in claim 9 wherein the first reservoir is located at least partially in front of the second reservoir.

17. An electric iron as in claim 9 wherein the fluid dispensing system comprises an electric pump connecting the first reservoir to the spray nozzle.

18. An electric iron as in claim 9 wherein the fluid dispensing system comprises an electronic pump connecting the second reservoir to a steam chamber in the soleplate.

* * * * *